United States Patent [19]

van der Lely

[11] 4,070,804

[45] Jan. 31, 1978

[54] BUILDINGS ERECTED FROM THREE OR MORE BOX-SHAPED SECTIONS, AND METHODS OF FABRICATING SUCH BUILDINGS

[76] Inventor: Cornelis van der Lely, 7, Bruschenrain, Zug, Switzerland

[21] Appl. No.: 633,977

[22] Filed: Nov. 20, 1975

Related U.S. Application Data

[63] Continuation of Ser. No. 445,924, Feb. 26, 1974, abandoned.

[30] Foreign Application Priority Data

Feb. 28, 1973 Netherlands ..... 7302761

[51] Int. Cl.[2] ..... E04H 1/12

[52] U.S. Cl. ..... 52/64; 52/79.5

[58] Field of Search ..... 52/79, 236, 64, 66, 52/745

[56] References Cited

U.S. PATENT DOCUMENTS

| | | | |
|---|---|---|---|
| 3,225,434 | 12/1965 | van der Lely | 52/79 |
| 3,404,496 | 10/1968 | Ballard | 52/64 |
| 3,624,977 | 1/1970 | Morton | 52/79 |
| 3,638,373 | 2/1972 | Chapman | 52/79 |
| 3,699,731 | 10/1972 | Arnold | 52/64 |
| 3,736,708 | 6/1973 | Chapman | 52/79 |

FOREIGN PATENT DOCUMENTS

| | | | |
|---|---|---|---|
| 60,142 | 11/1968 | Germany | 52/79 |

*Primary Examiner*—John E. Murtagh

*Attorney, Agent, or Firm*—Mason, Mason & Albright

[57] ABSTRACT

A building of prefabricated elongated box-shaped sections wherein several are connected along their longer sides. The roof has a roof portion for each section. Roof portions for side sections are hinged to supports outboard along the section's longer outer and upper edge, such roof portions being pivotable from the horizontal for transport to their ultimate inclined position. An I-beam is mounted along each portion's inboard edge with supports between it and the underlying section's top near its inboard side. A hoist member supported by the I-beams spans across the intermediate space. With one intermediate section, its roof portion is hinged providing two equal width parts folded together for transport. It is hoisted from a connection near the hinge and two furtherhoisting members place each roof part's lower edge on the I-beams (openings provided where hoist members bear thereon). So situated, the I-beams support the intermediate roof portion with the hinged located at the roof's ridge. With two intermediate sections, each has a two-part roof portion not necessarily hinged at its longitudinal center. As folded it can be carried on the section's top. Such portions are hoisted separately whereby the I-beams receive their outboard edges and further supports are provided from the underlying intermediate sections near where they are joined to connect with the intermediate roof portions where hinged. The roof parts' inboard edges meet at the roof's ridge. Intermediate sections are wider than side sections except as added by the roof portion parts extending laterally outboard to equalize the sections' over-all width.

34 Claims, 6 Drawing Figures

BUILDINGS ERECTED FROM THREE OR MORE BOX-SHAPED SECTIONS, AND METHODS OF FABRICATING SUCH BUILDINGS

This is a continuing application of application Ser. No. 445,924 filed Feb. 26, 1974 now abandoned.

SUMMARY OF THE INVENTION

This invention relates to buildings comprising three or more box-shaped sections, and methods of fabricating such buildings.

According to one aspect of the present invention there is provided a building comprising three or more box-shaped sections each enclosing part of the space of the building and at least one of which is located between two further sections and has a width exceeding the width of the space-enclosing part of any one of the sections which joins any other of the sections only on one side.

According to another aspect of the present invention there is provided a method of fabricating a building with a roof, the building being formed from box-shaped, prefabricated sections, wherein during the prefabrication of at least a number of box-shaped sections a roof portion or a wall portion or both for a space-enclosing part of the building is arranged above the box-shaped section so that said roof portion or wall portion or both can be arranged on or immediately adjacent a face of the box-shaped section for transport to the building site, where the roof portion or wall portion or both are displaced with respect to the box-shaped section so as to arrive at the position relative to the box-shaped section necessary to form at least part of the building.

BRIEF DESCRIPTION OF THE DRAWINGS

For a better understanding of the invention and to show how the same may be carried into effect, reference will now be made by way of example, to the accompanying drawings, in which.

DESCRIPTION OF THE PREFERRED EMBODIMENTS

Figure 1:
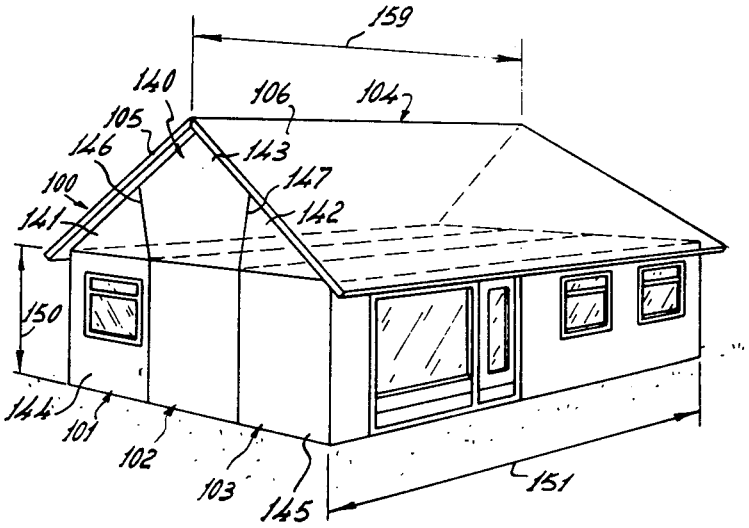
FIG. 1 is a perspective view of a first form of building.
Figure 2:
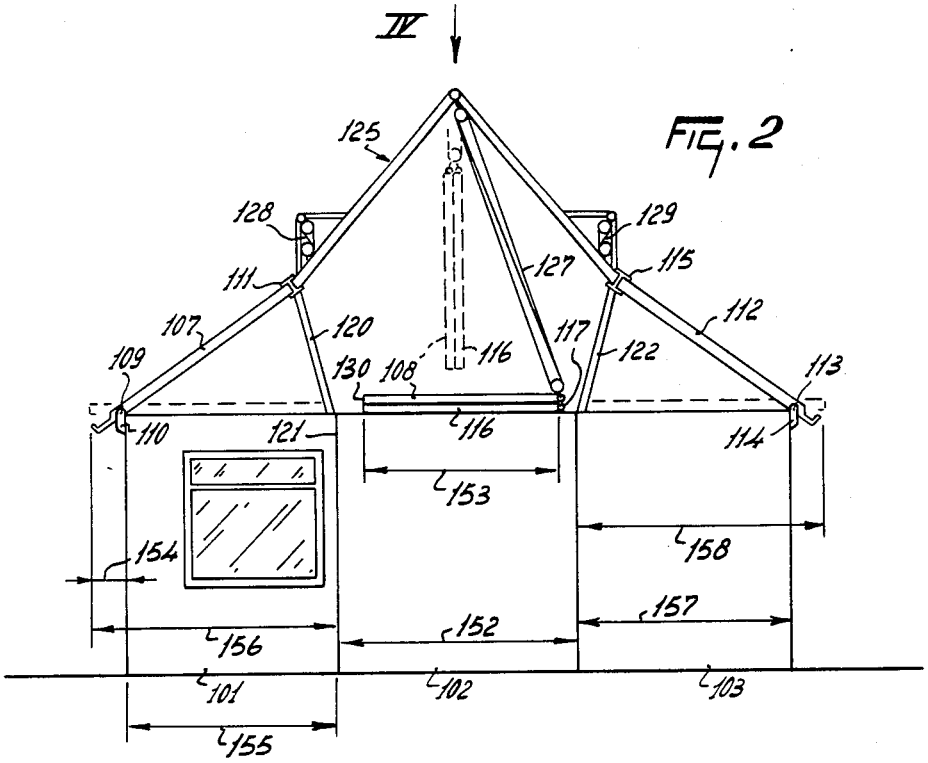
FIG. 2 is a schematic elevation of the building shown in FIG. 1, in which an intermediate phase of the placing of the roof in position is illustrated.
Figure 3:
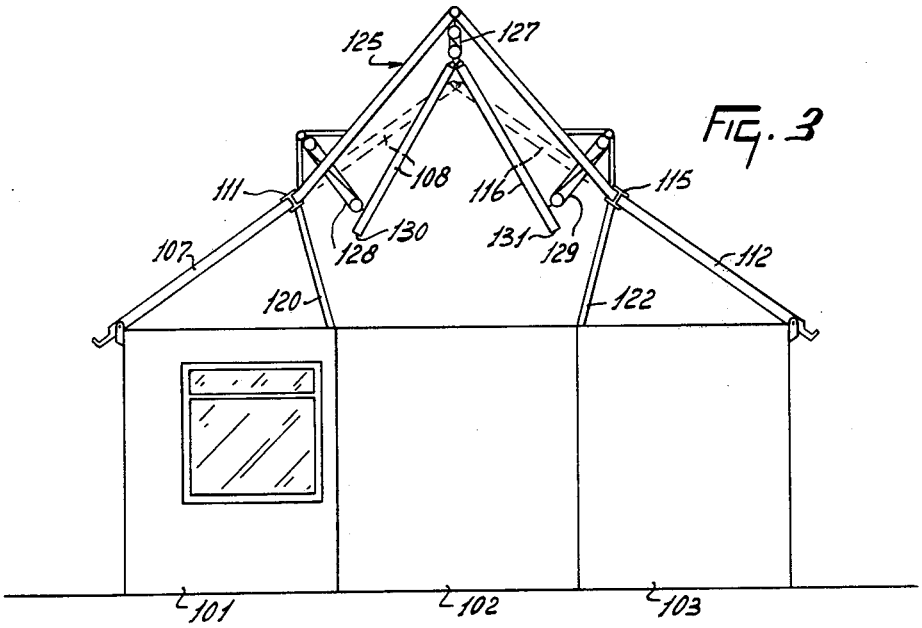
FIG. 3 is a schematic elevation similar to FIG. 2 but illustrating a further phase in placing the roof in position.

The building 100 shown in FIG. 1 is a dwelling and consists mainly of three prefabricated, box-shaped sections 101, 102 and 103. Each of these sections has substantially the shape of a parallelepiped and defines part of the living space of the building 100. The building 100 has a roof 104 having two sloping roof surfaces 105 and 106. The roof 104 encloses the space of the building 100 located above the space enclosed by the parallelepiped-shaped sections 101, 102 and 103. The building sections 101, 102 and 103 are prefabricated and subsequently transported to the building site, where they are positioned side-by-side by their long sides as is shown in FIGS. 1, 2 and 3 for erecting the building. The roof 104 is also prefabricated and transported together with the sections 101, 102 and 103 to the building site, where it is positioned as shown in FIG. 1.

Referring to FIGS. 2 and 3, the roof surface 105 is composed of two prefabricated portions 107 and 108. The roof portion 107 is fastened by means of a hinge 109 formed by pivotal shafts to supports 110, which are provided on the section 101. During prefabrication the roof portion 107 is provided with an I-section beam 111 at the edge of the portion 107 remote from the fastening area of the roof portion 107 to the supports 110. In similar manner the roof surface 106 is composed of two prefabricated portions 112, 116 of which the portion 112 is fastened by means of a hinge 113 formed by pivotal shafts to supports 114 of the section 103. The portion 112 has an I-section beam 115 corresponding to the beam 111 of the portion 107. The roof portion 116 corresponds with the roof portion 108. The roof portions 108 and 116 are fastened to each other by means of a hinge 117, being prefabricated and then interconnected by means of the hinge 117. After the prefabrication of the roof surface 107 and the section 101 they are interconnected by means of the hinge 109 so that the roof portion 107 and the section 101 can be transported to the building site as a single prefabricated unit. In the same manner the roof portion 112 and the section 103 are prefabricated as a single unit, the roof portion 112 being fastened to the section 103 by means of the hinge 113.

For the transport to the building site the roof portions 107 and 112 are disposed flat on the tops of the sections 101 and 103 respectively, as shown by broken lines in FIG. 2, and the roof portions 108 and 116 are disposed on the top of the section 102. In this manner the roof portions and sections are transported together from the factory where the roof portions and sections are prefabricated to the building site.

On the building site the sections 101, 102 and 103 are placed side-by-side. Then the roof portions 107 and 112 are turned upwards about the hinges 109 and 113 respectively into the position shown in FIGS. 2 and 3. At this stage the roof portion 107 is held by supports 120 placed on the top of the section 101 near the long side 121 thereof by which it joins the section 102. The supports 120, which are slightly inclined from the vertical, are fastened to the beam 111. Likewise the roof portion 112 is turned upwards about the hinge 113 and held by supports 122 placed on the top of the section 103 near the long side thereof opposite the side at which the hinge 113 is disposed.

Figure 4:
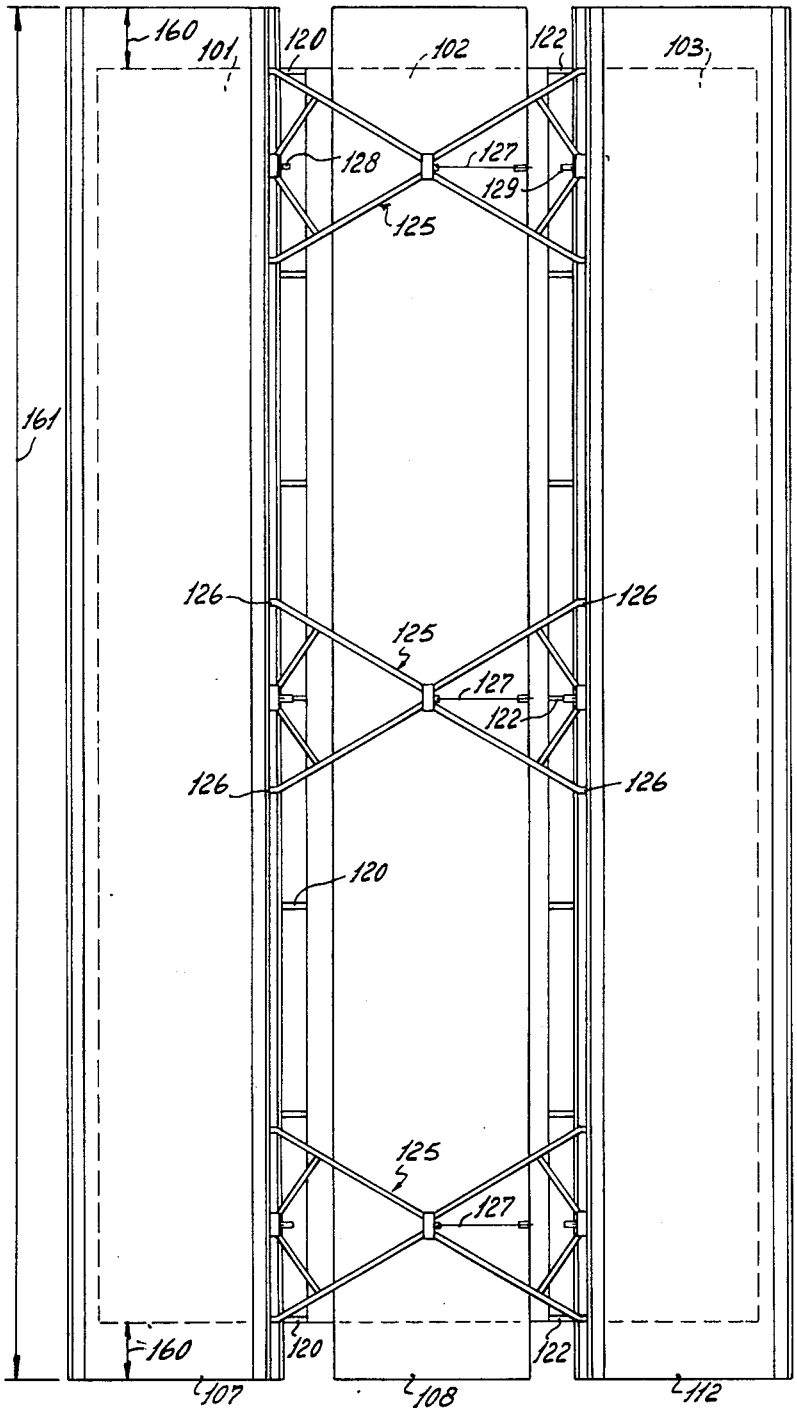
FIG. 4 is a plan view of the building.

After the roof portions 107 and 112 have been erected in the positions shown in FIG. 2, one or more hoisting members 125, in this embodiment three members are provided- see FIG. 4. These hoisting members 125 are placed by their feet 126 on the beams 111 and 115. The hoisting members each have lifting tackle 127, 128 and 129. Each hoisting member 125 is positioned so that its tackle 127 is located above the center of the section 102. Above this center is also disposed the hinge 117, which forms the ridge of the roof in the erected state of the roof portions 108 and 116.

After the erection of each hoisting member 125 the tackle 127 thereof is connected with the roof portions 108 and 116 near the hinge 117. For this purpose the roof portions 108 and 116 are provided with hooks. By means of the tackle 127 of each hoisting member 125 the roof portions 108 and 116 are lifted from the top of the section 102 into the position shown in broken line in FIG. 2. Then the tackle 128 of each hoisting member is fastened to the roof portion 108, and the tackle 129 of each hoisting member is fastened to the roof portion 116. Utilizing the tackle the roof portions 108 and 116 are moved away from each other as is shown in FIG. 3, that is they are moved so that the lower ends 130 and 131 of the roof portions 108 and 116 can be placed in the beams 111 and 115 respectively as is shown in broken lines in FIG. 3. The roof portions 108 and 116 are then located in line with the roof portions 107 and 111 so that the portions are in the desired positions to form the roof 104 of the building 110.

After the erection of the roof portions in the manner described the hoisting members 125 are removed. The roof portions 108 and 116 may be provided at the areas where the hoisting members 125 have to be supported by their feet 126 on the beams 111 and 115 with openings such that the roof portions 108 and 116 can be fastened to the beams 111 and 115 when the feet 126 of the hoisting members are held in the beams 111 and 115. After the removal of the hoisting members 125 these openings are closed in the roof portions 108 and 116.

During prefabrication of the roof portions 107, 108, 112 and 116 may be provided with roofing material. After the erection of the roof portions on the building to form the roof 104, the joining edges of the various roof portions can be covered by further roofing material. As an alternative, after the disposition of the roof portions in position to form the roof 104 roofing material may be applied to the whole roof, if this is not, or not completely, done during prefabrication.

The sections 101, 102 and 103 are preferably prefabricated to an extent such that on the building site it is only necessary to fasten the sections to each other and to erect the roof 104 in the manner described above.

The sections 101, 102 and 103 have a height 150 equal to the height of a story. The height 150 may, for example, be about 270 cms. The sections all have a length 151 of preferably more than 8 meters and smaller than 20 meters. In this embodiment the lenght 151 is about 1350 cms. The sections 101, 102 and 103 have such a width that in the state for transport their widths are equal to each other. The width of the sections in the transport state is preferably such that it is equal to or greater than 250 cms and smaller than 300 cms. The section 102 has a width 152 which is the same throughout the height of the section. The roof portions 108 and 116 have a width 153 which is smaller than the width 152. The roof portions 108 and 116 can therefore be readily arranged on the top of the section 102 for transport purposes. The roof portion 107 lies flat on the top of the section 101 during transport as is shown in FIG. 2. The roof portion 107 projects over the long outer side of the section 101 over a distance 154 beyond the section. The width 155 of the section 101 together with the distance 154 is equal to the width 152 of the section 102. The transport width 156 (determined by the roof portion 107) of the section 101 with the roof portion 107 is therefore equal to the transport width 152 of the section 102. In a similar manner the section 103 has a width 157 which is smaller than the transport width 158 of the section 103 with the roof portion 112 arranged thereon, the transport width 158 being determined by the width of the roof portion 112. The transport widths 158, 152 and 156 may be 275 cms. The space-enclosing parts of the sections 101 and 102, forming the two outermost sections of the three sections of the building, thus have widths 156 and 157, which are smaller than the width 152 of the section 102, which is the intermediate of the three sections.

The roof portions 107, 108, 112 and 116 have equal lengths. This length 159 is in the embodiment shown greater than the length 151 of the sections 101, 102 and 103. The roof portions, as is shown in detail in FIG. 4, project on either side of the ends of the elongated sections over a distance 160 beyond the sections. The overall length 161 of these roof portions, which determines the transport length of a section, is preferably not more than 15 meters. In this embodiment the length 161 is about 15 meters. However, the length 161 of the roof portions may be kept equal to the length 151. During transport the roof portions located on the sections form parts of the sections. The roof portions 108 and 116 thus form part of the section 102. The roof portions constitute the top parts of the transport units formed by the roof portions and the sections in which they are mounted. The parts located beneath the roof portions constitute space-enclosing parts of the sections.

After the roof 104 is erected, gables, for example, the gable 140 can be mounted on the facade shown in FIG. 1. These gables, as in this embodiment, may be formed by prefabricated portions as will now be described for the gable 140. The gable 140 consists of three portions 141, 142 and 153. The gable portions 141 and 142 are fastened to the roof portions 107 and 112 respectively during the prefabrication of the sections 101 and 102. The gable portions 141 and 142 are arranged so that they are located outside the prolongations of the facade portions 144 and 145 at the ends of the sections 101 and 103 respectively. In the transport state of the sections, the gable portions 141 and 142 are located at the sides of the facade portions 144 and 145. The gable portion 143 is a prefabricated panel placed between the gable portions 141 and 142. The gable portions 141 and 142 join the portion 143 along inclined edges 146 and 147. Owing to the fact that the gable portions 141 and 142 are connected to the roof portions 107 and 112 respectively, they are mounted to the space-enclosing parts of the sections 101 and 103 through the intermediary of these roof portions. The gable portions 143 are transported to the building site e.g. on the top of the section 102 in the same manner as the roof portions 108 and 116.

Figure 5:
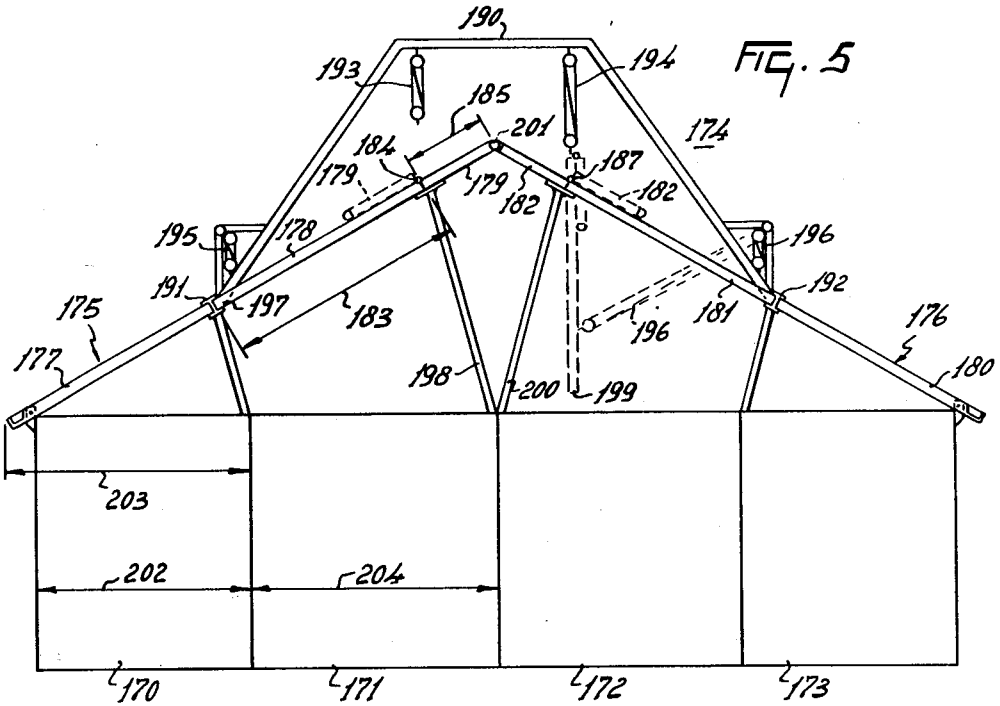
FIG. 5 is a schematic elevation illustrating placing of the roof on a building of a second form.

FIG. 5 shows a schematic elevation of a building which corresponds in principle with the building shown in FIGS. 1 to 4. The building shown in FIG. 5, however, has four sections 170, 171, 172 and 173, and a roof 174 having two inclined roof surfaces 175 and 176. The roof surface 175 consists of three portions 177, 178 and 179; and the roof surface 176 consists of three portions 180, 181 and 182. The sections 170 and 173 with the roof portions 177 and 180 hinged thereto correspond completely with the sections 101 and 103 with the roof portions 107 and 112 attached thereto already described. The sections 171 and 172 correspond with the section 102. The part of the roof consisting of the portions 178 and 179, and 180 and 182 is also prefabricated and after prefabrication the portions 178 and 179 are interconnected by means of a hinge 184. The portion 178 has a width 183 equal to or slightly smaller than the width 204 of the section 171. The width 204 is equal to the width 152 of the section 102. The roof portions 181 and 182 are prefabricated and interconnected by a hinge 187. The portion 181 has a width equal to the width 183 and the portion 182 has a width equal to the width 185 of the portion 179. The prefabricated and coupled portions 181 and 182 can be disposed on the top of the section 172.

The whole building can thus be prefabricated and be transported in the prefabricated state to the building site.

On the building site the sections 170 to 173 are placed side-by-side, after which the roof portions 177 and 180 are placed in the position shown in FIG. 5. The roof portions 177 and 180 may also be provided with gable portions such as the portions 141 and 142 of the roof portions 107 and 112. Then a hoisting mechanism 190 is placed on beams 191 and 192, which correspond with the beams 111 and 115. This hoisting mechanism 190 includes lifting tackle 193 and 194 and 195 and 196. The tackle 195 and 196 corresponds with the tackle 128 and 129 of the embodiment shown in FIGS. 2 and 3. By means of the tackle 193 the roof portions 178 and 179 are lifted from the top of the section 171 in the manner illustrated in FIG. 2. By means of the tackle 195 the lower end 197 of the roof portion 178 is placed in the beam 191. The roof portion 179 at this stage can still be located on the portion 178 as is shown indicated by broken lines in FIG. 5. The roof portion 178 is held in the final position shown in FIG. 5 near a hinge 184 by a support 198. Then the roof portion 179 can be pivoted. In the same manner the roof portion 181 is placed in position by means of the tackle 194 and 196. The portions 181 and 182 are first lifted from the section 172 by means of the tackle 194. From the position shown by broken lines in FIG. 5 the lower end 199 of the portion 181 is placed by means of the tackle 196 in the beam 192. On the section 172 a support 200 is placed for holding the roof portion 181 in the position shown in FIG. 5. Then the roof portion 182 is moved out of the position shown in FIG. 5 by broken lines into the position shown by full lines in FIG. 5. The portions 179 and 182 join each other so that they form the ridge 201 of the roof. After the disposition of the roof portions the hoisting mechanism 190 can be removed and the roof can further be finished at the joints of the various roof portions.

As in the preceding embodiments the sections 171 and 172 have a width 204 which exceeds the width 202 of the space-enclosing parts of the sections 170 and 173. The widths 203 are, however, equal to the width 204 of the sections 171 and 172. The sections located between further sections have also in this embodiment a box-shaped part of a width exceeding the width of the sections joining a further section by only one side, for example the sections 170 and 173. Also in this embodiment the transport widths 203 and 204 preferably exceed 240 cms but are smaller than 330 cms. The widths 203 and 204 in this embodiment are 275 cms.

Figure 6:
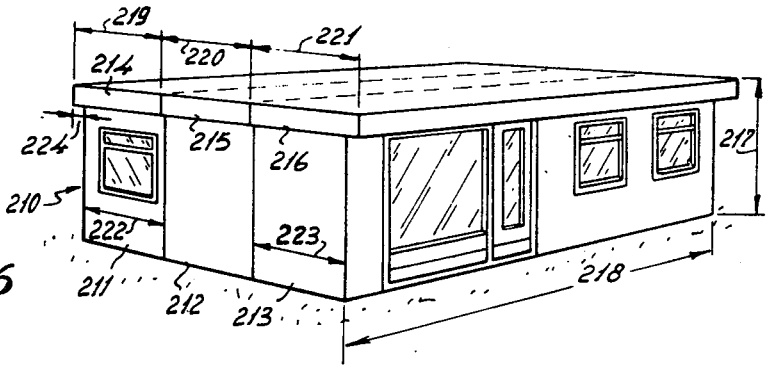
FIG. 6 is a perspective view of a third form of building.

FIG. 6 shows an embodiment of a building having a flat roof. The building 210 is made-up of three prefabricated, box-shaped sections 211, 212 and 213. Each of these sections is provided on its top with a portion 214, 215 or 216 forming part of the roof of the building 210. The sections 211, 212 and 213 are completely prefabricated with the roof portions 214, 215 and 216 arranged thereon. The sections have each a height 217 of about 270 cms and a length 218 preferably greater than 8 meters and smaller than 20 meters. Each of the sections has an overall width 219, 220 and 221 respectively, which are equal to each other. Each is preferably 275 cms. The roof portions 214 and 216 on the sections 211 and 212 project on the long sides of the sections beyond the box-shaped parts so that the sections 211 and 213 each have a width 222 and 223 respectively, which are equal to each other, but smaller than the widths 219 and 221. The widths 222 and 223 are, for example, 240 cms so that each of the roof portions 214 and 216 project over a distance 224 of about 30 cms beyond the long side of the section 211 and 213 respectively. The roof portions 214, 215 and 216 may project on the short sides of the sections also over about 30 cms beyond the box-shaped parts of these sections so that the flat roof of the building 210 projects beyond the facades of the building all around the circumference. The transport width is therefore the same for all sections. The overall transport length is slightly greater than the length 218.

Although various features of the buildings and methods of fabricating buildings which have been described, and illustrated in the drawings, will be set forth in the following claims as inventive features, it is to be appreciated that the invention is not necessarily limited to these features and encompasses all of the features which have been described and illustrated both individually and in various combinations.

What we claim is:

1. A building comprising three or more elongated box-shaped prefabricated sections each of which encloses part of the space of the building, at least one of said sections being located between and connected on its longer side to two further of said sections, said one section having a width of its space-enclosing part exceeding the width of the space-enclosing part of said further sections, said further sections being free of the other said sections on one side, one of said further sections being provided with a top construction which, viewed in plan, projects in a direction of width beyond the space-enclosing part of said one further section, the over-all width of said top construction being substantially equal to the width of the space-enclosing part of said one section, whereby the transport width of said one further section and said one section are substantially equal.

2. A building as claimed in claim 1, wherein said top construction comprises a roof portion.

3. A building as claimed in claim 2, wherein said top construction forms a roof surface arranged on the top of said one further section.

4. A building as claimed in claim 1, wherein said top construction consists primarily of roof construction having a width exceeding the width of said further section on which it is mounted.

5. A building as claimed in claim 1, wherein, as viewed on plan, at least one of said further sections is rectangular and is provided with a top construction which projects on three sides beyond the substructure of such section.

6. A building as claimed in claim 5, wherein said top construction of said one further section is hinged to a longer side of such section, said longer side forming an outer side of the building.

7. A building as claimed in claim 1, wherein at least one of said sections has a width exceeding about 250 cms but smaller than about 300 cms.

8. A building as claimed in claim 7, wherein at least one of said sections has a width of about 275 cms.

9. A building comprising three or more elongated box-shaped prefabricated sections each of which when viewed from above is substantially rectangular and encloses part of the space of the building, at least one of said sections being located between and connected on its longer sides to two further of said sections, said one section having a width of its space-enclosing part which exceeds the width of the space-enclosing part of each said further section, said further sections each being free of the other of said sections on one longer side which comprises a side of the building, each of said sections being provided with a top construction which, viewed from above, projects in a direction of length beyond the space-enclosing part of the section with which it corresponds and one of which projects in a direction of width beyond the space-enclosing part of said one further section by an amount which when added to the width of the space-enclosing part of said one further section substantially equals the width of said space-enclosing part of said one section, said top construction comprising roof portions arranged on each said section including an inclined roof portion which is arranged on the top of said one further section and at least one wall enclosing a space above said one further section.

10. A building as claimed in claim 9, wherein said top construction of each said section projects on both sides in the direction of length beyond the section with which it corresponds.

11. A building as claimed in claim 9, wherein said wall comprises a gable portion of the building.

12. A building as claimed in claim 11, wherein said gable portion is fastened to said roof portion.

13. A method of fabricating a building which comprises the steps of manufacturing at least three prefabricated elongated box-shaped sections, mounting side roof portions on the tops of two of said sections to be hingedly connected along a longer side of the underlying section, said two sections comprising opposite sides of the building, placing a further roof portion comprised of two roof parts which are hinged together on an intermediate section of said sections, said roof parts being folded together and all said roof portions being substantially horizontally disposed on the tops of their respective sections, transporting said sections to the building site and connecting them together in the relationship they occupy in the completed building whereby said side sections have their roof portions hingedly connected thereto along their outboard sides, pivoting each said side roof portion to an inclined position and placing support members between the non-hinged longer side of each roof portion and the underlying section whereby said side roof portions are supported to occupy their position in the completed building, providing connecting means along the longer non-hinged side of each side roof portion, raising said further roof portion vertically above said intermediate section, mounting an edge of said further roof portion to adjoin a said side roof portion by said connection means and unfolding and securing said roof parts to the position they occupy in the completed building.

14. A method in accordance with claim 13, wherein a hoisting member is placed on said connection means, said further roof portion being raised to a position to be mounted on said connection means by said hoisting member.

15. A method in accordance with claim 14, wherein said hoisting member unfolds said roof parts.

16. A method in accordance with claim 13, wherein at least one of said side sections has a width less than the intermediate section, transporting gable wall portions with such section to the building site.

17. A building comprising three or more elongated box-shaped sections each of which encloses part of the space of the building, at least one of said sections being located between two further of said sections, said one section having a width of its space-enclosing part which exceeds the width of the space-enclosing part of each of said further sections, said further sections each being free of the other of said sections on one side which comprises a side of the building, one of said further sections being provided with a top construction which, viewed from above, projects in a direction of width beyond the space-enclosing part of said one further section and on a free side thereof by an amount which then added to the width of the space-enclosing part of said one further section substantially equals the width of said space-enclosing part of said one section, said top construction comprising a roof structure, hinge means including a hinge shaft extending along said free side comprising a long side of said one further section hingedly mounting said roof structure, said roof structure comprising a substantially rigid non-foldable component.

18. A building in accordance with claim 17, wherein said hinge shaft has its axis of rotation spaced laterally outboard of said free side of the building and above the top of the space-enclosing part of the section which it is attached whereby said roof structure hinged thereto is pivotable from a position flush with said top to an inclined position.

19. A building comprising three or more elongated box-shaped prefabricated sections each of which encloses part of the space of the building, at least one of said sections being located between two further of said sections, said one section having a width of its space-enclosing part which exceeds the width of the space-enclosing part of each of said further sections, each said further section being free of the other of said sections on one of its longer sides which comprises a side of the building, each of said further sections being provided with a roof portion which, when viewed from above, projects in a direction of width beyond the free side of each said further section by an amount which when added to the width of the space-enclosing part of its corresponding said further section equals the width of said space-enclosing part of said one section, and at least one of said sections located between said two further sections being provided with a further roof portion fastened to said first-mentioned roof portions of said two further sections, hinge means mounted on the free side of each said further section, said hinge means hingedly connecting said first-mentioned roof portions to said further sections along the free sides thereof, roof supporting beams provided on the opposite side of each said further section from said hinge means, said further roof portion located between and fastened to said first-mentioned roof portions extending across at least one of said sections located between said further sections, said further roof portion comprising two relatively pivotable parts.

20. A building in accordance with claim 19, wherein each said hinge means has its axis of rotation spaced laterally outboard the free side of the building and above the top of the space-enclosing part of the section to which it is attached whereby said roof portion hinged thereto is pivotable from a position flush with said top to an inclined position.

21. A building in accordance with claim 19, wherein said roof parts for said one intermediate section have a combined width less than double the overall width of said intermediate section.

22. A building as claimed in claim 19, wherein with respect to the horizontal, said supporting beams are arranged in inclined positions so as to slope towards the side along which said hinge means is located.

23. A building as claimed in claim 19, wherein said two relatively pivotable parts have equal lengths.

24. A building as claimed in claim 23, wherein one of said two relatively pivotable parts has a width substantially equal to the width of the other said pivotable part.

25. A building which comprises three or more elongated prefabricated sections, said sections being connected together along their longer sides, two of said sections being side sections and there being at least one intermediate section, said side sections each having a roof portion hingedly connected thereto along its longer outer side whereby the section is transportable with the roof in a substantially horizontal position which is pivotable to its inclined position in the completed building at the building site, connection means mounted at the side of each roof portions away from the hinged side, a further roof portion above said intermediate section, said further roof portion including pivot means whereby it is foldable between its longitudinal edges about a longitudinal axis and is transportable in the folded position on top of said intermediate section, at least one said further roof portion being received in the completed building by one of said connection means mounted on a first-mentioned roof portion.

26. A building in accordance with claim 25, wherein said roof portions hingedly connected to said side sections along their longer sides include hinge means for said connections, said hinge means each having its axis of rotation spaced laterally outboard of the free side of the building and above the tops of the space-enclosing part of the section to which it is connected whereby said roof portion hinged thereto is pivotable from a position flush with the said top to said inclined position.

27. A building in accordance with claim 25, wherein said further roof portion has a width less than double the width of said intermediate section.

28. A building in accordance with claim 25, wherein the longitudinal axis of said pivot means bisects said further roof portion.

29. A building according to claim 25, wherein said pivot means defines the ridge of the roof of the building.

30. A building which comprises at least three box-shaped elongated prefabricated sections, said sections being connected together along their longer sides, two of said sections being side sections and at least one of said sections being an intermediate section, said side sections each having a side roof portion hingedly connected thereto by hinge means along its longer outboard side whereby each side section is transportable with said side roof portion in a substantially horizontal position which is pivotable to its inclined position in a completed building at the building site, connection means mounted at the inboard side of each said side roof portion, support members extending between said connection means and the top of the underlying side section, an intermediate roof portion carried on the top of said intermediate section, a removable hoisting member mounted on and supported by both said connection means bridging across said intermediate section, hoisting means included in said hoisting member adapted to lift said intermediate roof portion into position whereby each longitudinal edge thereof is received by a corresponding connection means of said side roof portions to form a completed roof on the building.

31. A building in accordance with claim 30, wherein said hinge means has its axis of rotation spaced laterally outboard of a longer outboard side of the building and above the top of the space-enclosing part of a side section to which it is attached whereby said roof portion hinged thereto is pivotable from said substantially horizontal position which is flush with said top of said inclined position.

32. A building in accordance with claim 30, wherein said intermediate roof portion comprises two roof parts which have a combined width less than double the width of said intermediate section.

33. A building in accordance with claim 32, wherein said roof parts are hinged together and the longitudinal axis of said hinge for said roof parts bisects said intermediate roof portion.

34. A building comprising three or more elongated box-shaped prefabricated sections each of which encloses part of the space of the building, at least one of said sections being located between two further said sections, said one section having a width of its space-enclosing part exceeding the width of the space-enclosing part of each said further section, said further sections being free of the other said sections on one side, one of said further sections provided with a top construction which, viewed in plan, projects in a direction of width beyond the space-enclosing part of said one further section, the over-all width of said top construction being substantially equal to the width of the space-enclosing part of said one section, whereby the transport width of said one further section and said one section are substantially equal, at least one of said further sections viewed in plan being rectangular and provided with a top construction which projects on three sides beyond the substructure of such section, said top construction of said one further section being hinged to a longer side of such section, said longer side forming an outer side of the building.

* * * * *